US009737927B2

(12) United States Patent
Koch et al.

(10) Patent No.: US 9,737,927 B2
(45) Date of Patent: Aug. 22, 2017

(54) THERMAL REGENERATION OF FOUNDRY SAND

(75) Inventors: Diether Koch, Mettmann (DE); Jens Müller, Haan (DE); Marcus Frohn, Dormagen (DE)

(73) Assignee: ASK Chemicals GmbH, Hilden (DE)

( * ) Notice: Subject to any disclaimer, the term of this patent is extended or adjusted under 35 U.S.C. 154(b) by 1402 days.

(21) Appl. No.: 12/527,685

(22) PCT Filed: Feb. 19, 2008

(86) PCT No.: PCT/EP2008/001286

§ 371 (c)(1),
(2), (4) Date: Mar. 1, 2010

(87) PCT Pub. No.: WO2008/101668

PCT Pub. Date: Aug. 28, 2008

(65) Prior Publication Data

US 2010/0173767 A1 Jul. 8, 2010

(30) Foreign Application Priority Data

Feb. 19, 2007 (DE) ..... 10 2007 008 149

(51) Int. Cl.

| | |
|---|---|
| ***C04B 35/14*** | (2006.01) |
| ***B22C 1/00*** | (2006.01) |
| ***C04B 35/10*** | (2006.01) |
| ***B22C 5/06*** | (2006.01) |
| ***B22C 5/08*** | (2006.01) |

(52) U.S. Cl.
CPC ..... *B22C 5/06* (2013.01); *B22C 5/085* (2013.01)

(58) Field of Classification Search
CPC ..... B22C 5/06; B22C 5/085
USPC ..... 164/529; 106/38.2
See application file for complete search history.

(56) References Cited

U.S. PATENT DOCUMENTS

| | | | | |
|---|---|---|---|---|
| 2,682,092 | A | 6/1954 | Henricks | |
| 2,881,081 | A | 4/1959 | Henricks | |
| 2,895,838 | A | 7/1959 | Ilenda | |
| 3,409,579 | A | 11/1968 | Robins | |
| 4,162,238 | A * | 7/1979 | Bergna | 524/442 |
| 4,416,694 | A * | 11/1983 | Stevenson et al. | 106/634 |
| 5,582,232 | A | 12/1996 | Bambauer et al. | |
| 5,747,606 | A | 5/1998 | Pfaendner et al. | |
| 6,972,059 | B1 | 12/2005 | Skerdi | |
| 2008/0099180 | A1* | 5/2008 | Weicker et al. | 164/529 |

FOREIGN PATENT DOCUMENTS

| | | | |
|---|---|---|---|
| DE | 18 06 842 | A1 | 5/1970 |
| DE | 38 15 877 | C1 | 8/1989 |
| DE | 41 11 643 | A1 | 10/1991 |
| DE | 43 06 007 | A1 | 11/1994 |
| DE | 199 18 316 | A1 | 12/1999 |
| DE | 199 25 167 | A1 | 12/2000 |
| DE | 10 2005 029 742 | B3 | 8/2006 |
| EP | 0 612 276 | B2 | 11/2004 |
| FR | 2 696 367 | | 4/1994 |
| GB | 692030 | | 5/1953 |
| GB | 782205 | | 9/1957 |
| GB | 2 246 974 | A | 2/1992 |
| JP | 53-106385 | | 9/1978 |
| JP | 64-083333 | | 3/1989 |
| JP | 6-344076 | | 12/1994 |
| JP | 07-195139 | | 8/1995 |
| WO | WO 94/04297 | | 3/1994 |
| WO | WO 2006/024540 | A2 | 3/2006 |

OTHER PUBLICATIONS

European Search Report dated Nov. 14, 2012 (in German).
Japanese Office Action, "Notice of Reasons for Rejection," dated Jun. 28, 2012 in Japanese with its English translation.
Russian Office Action, "Inquiry of Substantive Examination," dated Feb. 2, 2012 in Russian with its English translation.
M.B. Zaigerov, "Regeneratsiya otrabotannykh smesei v liteinom proizvodstve" ("Regenerating used foundry mixtures in foundry industry"), Moscow, Mashgiz, (1961), pp. 28, 29 and 53 (in Russian).
M. Ruzbehi, "Thermo-mechanische Regenerierung von Formstoffen mit einem Wasserglas-Ester-Bindersystem", Giesserei, Giesserei Verlag Düsseldorf, DE, vol. 74, pp. 318-321 (1987).
VDG-Merkblatt P28, (May 1979).
Thomas Oehlerking, "Usability of reclaimed material from combined thermal reclamation of different core sands", Giesserei, Giesserei Verlag Düsseldorf, DE, vol. 80, pp. 721-728 (Nov. 1993); and English abstract.

* cited by examiner

*Primary Examiner* — Shuangyi Abu Ali
(74) *Attorney, Agent, or Firm* — Locke Lord LLP; Alan B. Clement; Peter J. Fallon

(57) ABSTRACT

The invention relates to a method for regenerating used foundry sand, which is contaminated with soluble glass, wherein: used foundry sand is provided, which is tainted with a binding agent made of the soluble glass, to which a particle-shaped metal oxide is added; and the used foundry sand is subjected to a thermal treatment, wherein the foundry sand is heated to a temperature of at least 200° C., thereby obtaining regenerated foundry sand. The invention further relates to regenerated foundry sand, as that obtained from using the method.

20 Claims, No Drawings

THERMAL REGENERATION OF FOUNDRY SAND

The invention relates to a method for the regeneration of foundry sands which are tainted with water glass as well as a mould material such as can be obtained by this method.

Casting moulds for producing metal bodies are substantially manufactured in two designs. A first group form the so-called cores or moulds. The casting mould is assembled from these, substantially forming the negative mould of the casting to be produced. A second group form hollow bodies, so-called feeders which act as a compensating reservoir. These receive liquid metal, it being ensured by suitable measures that the metal remains longer in the liquid phase than the metal located in the casting mould forming the negative mould. If the metal solidifies in the negative mould, liquid metal can flow from the compensating reservoir in order to compensate for the volume contraction accompanying the solidification of the metal.

Casting moulds consist of a refractory material, for example, quartz sand whose grains are connected by a suitable binding agent after shaping the casting mould in order to ensure a sufficient mechanical strength of the casting mould. A foundry sand which has been treated with a suitable binding agent is therefore used for producing casting moulds. The refractory mould base material is preferably present in a pourable form so that it can be poured into a suitable hollow mould and compacted there. The binding agent produces a solid cohesion between the particles of the mould base material so that the casting mould acquires the necessary mechanical stability.

Casting moulds must satisfy various requirements. During the casting process itself, they must firstly exhibit a sufficient stability and temperature resistance in order to receive the liquid metal into the hollow mould formed from one or more casting (partial) moulds. After commencement of the solidification process, the mechanical stability of the casting mould is ensured by a solidified metal layer which forms along the walls of the hollow mould. The material of the casting mould must now disintegrate under the influence of the heat released by the metal in such a manner that it loses its mechanical strength, i.e. the cohesion between individual particles of the refractory material is eliminated. This is achieved by the binding agent, for example, decomposing under the action of heat. After cooling, the solidified casting is shaken in which case the material of the casting moulds ideally disintegrates to a fine sand which can be poured out from the hollow spaces of the metal mould.

Both organic and inorganic binding agents can be used to produce the casting moulds, which can be cured in each case by cold or hot methods. In this context, cold methods are designated as those methods which are substantially carried out at room temperature without heating the casting mould. The curing usually takes place in this case by a chemical reaction which is triggered, for example, by a gas being passed as catalyst through the mould to be cured. In hot methods, the moulding material mixture is heated to a sufficiently high temperature after the shaping in order, for example, to expel the solvent contained in the binding agent or in order to initiate a chemical reaction by which means the binding agent is cured, for example, by cross linking.

At the present time, such organic binding agents are frequently used for the production of casting moulds in which the curing reaction is accelerated by a gaseous catalyst or which are cured by reaction with a gaseous curing agent. These methods are designated as "cold box" methods.

An example for the production of casting moulds using organic binders is the so-called polyurethane cold box method. The first component consists of the solution of a polyol, mostly a phenol resin. The second component is the solution of a polyisocyanate. Thus, according to U.S. Pat. No. 3,409,579 A, the two components of the polyurethane binder are made to react by passing a gaseous tertiary amine through the mixture of mould base material and binding agent after the shaping. The curing reaction of polyurethane binding agents comprises a polyaddition, i.e. a reaction without any elimination of by-products such as, for example, water. Further advantages of this cold box method include good productivity, dimensional accuracy of the casting moulds, as well as good technical properties such as the strength of the casting moulds, the processing time of the mixture of mould base material and binding agent etc.

The hot-curing organic methods include the hot box method based on phenol or furan resins, the warm box method based on furan resins and the Croning method based on phenol novolac resins. In the hot box and warm box methods liquid resins are processed to give a moulding material mixture using a latent curing agent which is only effective at elevated temperature. In the Croning method, mould base materials such as quartz, chrome ore, zirconium sand etc. are encased at a temperature of around 100 to 160° C. with a phenol novolac resin which is liquid at this temperature. Hexamethylene tetramine is added as a reaction partner for the subsequent curing. In the aforesaid hot-curing technologies, the shaping and curing takes place in heatable tools which are heated to a temperature of up to 300° C.

Regardless of the curing mechanism, all organic systems have in common that during the pouring of the liquid metal into the casting mould, they thermally decompose and at the same time contaminants such as, for example, benzene, toluene, xylene, phenol, formaldehyde and higher, partially unidentified, cracking products can be released. It has indeed been possible to minimise these emissions by various measures but they cannot be completely avoided in the case of organic binders. Even in inorganic-organic hybrid systems which contain a fraction of organic compounds such as, for example, the binding agents used in the resol-$CO_2$ method, such undesirable emissions occur during casting of the metals.

In order to avoid the emission of decomposition products during the casting process, binding agents based on inorganic materials or which at most contain a very small fraction of inorganic compounds must be used. Such binding agent systems have already been known for some time. Binding agent systems have been developed which can be cured by introducing gases. Such a system is described, for example, in GB 782 205 which uses an alkali water glass as binding agent which can be cured by introducing $CO_2$. DE 199 25 167 describes an exothermic feeder compound which contains an alkali silicate as binding agent. Binding agent systems have furthermore been developed which are self-curing at room temperature. Such a system based on phosphoric acid and metal oxides is described, for example, in U.S. Pat. No. 5,582,232. Finally, inorganic binder systems which are cured at higher temperatures, for example, in a hot tool are known. Such hot-curing binder systems are known, for example, from U.S. Pat. No. 5,474,606 which describes a binder system consisting of alkali water glass and aluminum silicate.

During the production of castings, large amounts of used foundry sand tainted with binding agent residues accumulate. Thus used sand must either be disposed of or processed in a suitable manner so that it can optionally be reused for producing casting moulds. The same applies to so-called overflow sand, i.e. sand which is mixed with binding agent but has not been cured as well as to cores or core fragments which have not undergone casting.

Mechanical regeneration is the most widely used, in which the binding agent residue or decomposition products remaining on the used foundry sand after casting are removed by friction. To this end, the sand can, for example, be vigorously moved so that the binding agent residues adhering to these sand grains are removed by collision between adjacent sand grains. The binding agent residues can then be separated from the sand by sieving and deducting.

Frequently however, the binding agent residues cannot be completely removed from the sand by the mechanical regeneration. Furthermore, as a result of the strong forces acting on the sand grains during the mechanical regeneration, strong abrasion can occur or the sand grains can splinter. The sand processed by mechanical regeneration therefore usually does not have the same quality as new sand. If the mechanically regenerated sand is thus used to produce casting moulds, this can have the result that castings of lower quality are obtained.

In order to remove residues of organic binding agents, the used foundry sand can be heated whilst admitting air so that the binding agent residues burn. DE 41 11 643 describes an apparatus for the continuous regeneration of synthetic resin-bound used foundry sands. In this case, after a mechanical pre-cleaning, the used foundry sand is supplied to a thermal regeneration stage in which the organic binding agent residues remaining on the sand grains are burnt. The thermal regeneration stage comprises a sand pre-heater, a cascade oven operating continuously on the counterflow principle with fluidised beds located one above the other in individual stages as well as a sand cooler. The cool air forcibly flowing through the sand cooler in coils is supplied to the furnace as hot air for creating turbulence. It is also used as burner air. Furthermore, the hot air from the interior of the sand cooler is fed to the sand pre-heater for heating the sand. Thus, a temperature distribution in the furnace is achieved which at no point results in combustion which is incomplete and therefore forms harmful exhaust gases.

Usually the used sand is separated from the casting before the reprocessing. However, a method is also known in which the castings together with the cores and moulds produced using organic binding agents are heated in a furnace to a temperature of about 400 to 550° C. for a fairly long time immediately after the casting. Along with the removal of the organic binding agent, the thermal treatment also brings about a metallurgical modification of the casting.

Thus, EP 0 612 276 B2 describes a method for the heat treatment of a casting with a sand core adhering thereto, which comprises sand bound to a combustible binding agent, whereby the sand can be reclaimed from the sand core. In this case, the casting is introduced into a furnace and heated in the furnace so that parts of the sand core are separated from the casting. The separated sand particles collecting inside the furnace are reclaimed. The reclaiming process step in this case comprises at least one fluidisation of the separated sand core parts inside the furnace. The fluidisation of the separated sand core parts can be effected, for example, by introducing compressed air whereby the sand particles are held suspended.

Used foundry sands contaminated with inorganic binding agents such as water glass, for example, can be reprocessed by mechanical regeneration. In this context, a thermal pre-treatment of the used sand can achieve an embrittlement of the binding agent film surrounding the sand grain so that the binding agent film can be abraded mechanically more easily.

DE 43 06 007 A 1 describes a thermal processing of foundry sand contaminated with water glass. The used foundry sand is obtained from moulds which were cured with acidic gases, mostly carbon dioxide. The used foundry sand is initially mechanically crushed and then heated to a temperature exceeding 200° C. Due to the thermal treatment, contaminating constituents are destroyed or converted in such a manner that the foundry sand is suitable for a further moulding process. The description comprises no examples so that the precise execution of the method remains unclear. In particular it is not described whether the binding agent is abraded mechanically by the sand grains after the thermal treatment of the used sand.

DE 1 806 842 A also describes a method for regenerating used foundry sands in which the used sand is initially annealed and then specially treated for removing binding agent residues. In this case, all used foundry sands can be used per se regardless of whether these have been bound by organic or inorganic binding agents. Processing by washing with water is merely recommended for cement-bound foundry sands. In order to remove binding agent residues from the annealed used foundry sand, the annealed sand is initially cooled and any binding agent residues which may still be present are removed from this by gentle friction or collision of the sand grains. The sand is then sifted and deducted.

The annealed sand is preferably cooled in a shock manner by water to a temperature of somewhat above 100° C., whereby shrinkage stresses are triggered in the binding agent residues and due to the sudden formation of steam, binding agent residues are forced open from the surface of the sand grain, with the result that the binding agent residues can be removed more easily from the sand grains.

M. Ruzbehi, Giesserei 74, 1987, p. 318-321 reports on investigations of the thermo-mechanical regeneration of moulding materials having a water glass-ester binder system. Due to thermal treatment of the used sand, the water glass-ester system used as binding agent becomes embrittled and can therefore be abraded mechanically more easily from the sand grains.

The author assumes that the $Na_2O$ content is crucial for the regeneration of water glass bound sand. As the $Na_2O$ content increases, the refractoriness of the sand decreases. The ester residues remaining in the used sand when using the water glass-ester binder system result in uncontrolled curing behaviour when this is re-used. Since the concentration of ester residues in the used sand can only be determined with difficulty, the author uses the $Na_2O$ content of the regenerated sand as a scale for the reprocessing, i.e. the removal of the binding agent from the used sand. After repeated circulation of the sand, an equilibrium of the $Na_2O$ content in the regenerated used sand is established from approximately the seventh revolution. During the thermal treatment the used sand is heated to about 200° C. As a result, no sintering of the sand grains occurs. In microscopic photographs of the thermally treated sand grains, some embrittlement and tearing of the binding agent film can be observed so that this can be abraded mechanically from the sand grain.

However, it has been shown that the abrasion of the binding agent only takes place very incompletely and the grains have a rough surface after the treatment. Compared to new sand, the regenerated used sand exhibits a number of disadvantages. Thus, the regenerated used sand can be shot less efficiently on conventional core shooting machines. This is shown, for example, in the lower density of the mouldings produced from the regenerated used sand. The mouldings produced from regenerated used sand also show a lower strength. Finally, the processing time of moulding material mixtures produced from regenerated used sand is shorter than for mixtures which have been produced using new sand. The moulding material mixtures produced from mechanically regenerated used sand become encrusted considerably more rapidly.

The processing time of such moulding material mixtures produced from mechanically regenerated used sand can be improved by adding about 0.1 to 0.5 wt. % water which has optionally been mixed with a tenside to the moulding material mixture. This measure can also improve the strength of the moulding produced from this moulding material mixture. However, the regenerated used sand does not achieve the quality of new sand due to this measure. Furthermore, the results are only reproducible to a limited extent so that uncertainties appear in the process of producing casting moulds which cannot be accepted in industrial production per se.

Inorganic binding agents, in particular those based on water glass are largely water soluble even after curing the casting mould. The processing of the foundry sand can therefore also be accomplished by washing away residue of the inorganic binding agent on the sand with water. The water can already be used to clean the casting of adhering used sand. Thus, for example, the production line described in EP 1 626 830 provides wet core removal. However, the regeneration of the used sand is not discussed.

DE 10 2005 029 742 describes a method for treating foundry moulding materials, wherein some of the used foundry sand is washed with water. For this purpose, the used sand bound to the inorganic binding agent is separated dry from the casting after the casting. Lumpy pieces are crushed dry. The crushed sand is screened to give a specified grain size and undesirable fines removed. The screen sand is divided into two partial streams, one partial stream being fed to an intermediate store. The other partial stream is washed with water until the grain surface is sufficiently cleaned from residue of the binding agent and products of the casting process. After the washing the washing water is separated and the sand dried. A fraction of the screened used sand removed from the intermediate store can then be added to the washed sand again.

The wet cleaning of the used foundry sand is very efficient per se. The strengths of the cores fabricated from the washed regenerated used sand approximately correspond to the values achieved when using new sand. However, the processing time for these moulding material mixtures produced from regenerated used sand is somewhat shorter than when using new sand. However, the cleaning of the used sand is very expensive since large quantities of washing water accumulate which must be cleaned again. Another disadvantage is that the wet sand must be dried again before being reused.

DE 38 15 877 C1 finally describes a method for separating inorganic binding agent systems during the regeneration of used foundry sands in which a suspension of the used sand, for example, in water is treated with ultrasound. Bentonite, water glass and cement are specified as exemplary binding agent systems. According to a preferred embodiment, the used sand can be subjected to a thermal processing before the ultrasound treatment. Preferred temperature ranges for the thermal pre-treatment are specified as 400 to 1200° C., particularly preferably 600 to 950° C. The processing of used sand to which bentonite/carbon adheres as binding agent residues is described in the examples. The thermal treatment is used to remove carbon which becomes enriched in the form of polyaromatic carbons in a concentration in bentonite which does not allow direct reuse.

As explained above, the importance of binding agents based on water glass increases for the production of casting moulds since harmful emissions during the casting process can be significantly reduced in this way. Recently, very efficient binding agents based on water glass have been developed for the foundry industry which contain fractions of a fine-particle metal oxide, in particular fine-particle silicon dioxide. These binding agents are cured hot, i.e. by evaporation of the water contained in the water glass. By adding the fine-particle metal oxide, inter alia the strengths directly after removal from the hot tool are increased so that very complex cores can also be produced using this inorganic binding agent. Such a binding agent based on water glass is described, for example, in WO 2006/024540 A.

During the regeneration of used sands which had previously been solidified hot using such a water-glass-based binding agent, however, it was observed that the regenerated used sand has a reduced processing time when re-used with a water-glass-based binding agent. In order to counter this problem and achieve a suitable processing time for industrial applications, a higher quantity of new sand, for example, can be added to the regenerated used sand in order to reduce the relative fraction of the binding agent entrained with the regenerated used sand. It is also possible to mix the regenerated used sand with other regenerated used sands having different properties. The used sands are selected so that a satisfactory processing time is achieved after renewed addition of a water-glass containing binding agent.

By using the newly developed water-glass-based binding agents as already described, it is also possible to produce cores and moulds having very complex geometry. Since it is to be expected as a result of the increasingly more stringent emission and work protection regulations, that the importance of inorganic binding agents for the foundry industry will increase, larger quantities of used sands tainted with water glass will accumulate in future which must be reprocessed. There is therefore a high requirement for methods for regenerating used mould sand, wherein these should be easy to carry out and must provide a reproducible quality of the regenerated used sand, i.e. the regenerated used sand should substantially be able to be processed in the same way as new sand.

It was therefore the object of the invention to provide a method for reprocessing foundry sands tainted with water glass which can be carried out simply and favourably so that the sand has a high quality for the production of foundry moulds even after repeated reprocessing. In particular, this method should be capable of regenerating those used sands which had previously been hardened using a water-glass-based binding agent to which, inter alia a particular metal oxide, in particular silicon dioxide, had been added to increase the strength.

This object is achieved with a method having the features of patent claim 1. Advantageous embodiments of the method according to the invention are the subject matter of the dependent claims.

It has surprisingly been found that the cohesion between grains of a foundry sand decreases significantly if the used casting mould as present after the metal casting is heated for a fairly long time to a temperature of at least 200° C. The mould sand reprocessed by thermal treatment shows no premature curing when re-used with a water-glass-based binding agent. The processing time of the regenerated used sand is comparable to the processing time of new sand. In this case, it is not necessary for the binding agent to be mechanically abraded from the sand grains after the thermal treatment. Rather, the regenerated used sand can be re-used directly after the thermal treatment. A classification can optionally be carried out to remove excess grain, for example, by screening or air separation.

The inventors assume that during regeneration of the used sand by mechanical abrasion of the binding agent from the sand grain or during at least partial wet processing, small quantities of the particulate/particle-shaped metal oxide, in particular silicon dioxide, are entrained with the regenerated used sand into a newly prepared moulding material mixture. The particulate metal oxide can presumably trigger a premature curing of the water glass which significantly reduces the processing time of the moulding material mixture.

However, if the used sand is thermally treated as in the method according to the invention, the particulate metal oxide present in the binding agent adhering to the sand grains presumably effects a vitrification of the adhering water glass. A glass-like layer forms from the water glass on the sand grain which possesses only a low reactivity. This is shown, for example, in that the quantity of extractable sodium ions decreases during the regeneration of the sand and is very low in the regenerated sand.

The strength of the used casting mould decreases significantly due to the thermal treatment so that this decomposes even in the case of weak mechanical action. The decomposition mechanism is unclear in this case. However, it is assumed by the inventors that the water glass adhering to the foundry sand reacts at least partially with the sand grain and a thin glass sheath can form on the surface of said sand under the influence of the particulate metal oxide, in particular silicon dioxide. The surface of the sand grain is thereby smoother so that after renewed incorporating into a moulding material mixture, it can be processed without any problems in core shooters to give mouldings.

The water glass remaining on the sand grain merely leads to an insignificant increase in the grain size so that the foundry sand can run through several cycles before the re-processed sand grains are separated, for example, during a classification following the thermal regeneration, such as a screening step, on account of an excessive increase in size.

The progress of the regeneration of the used foundry sand can be tracked, for example, by determining the acid consumption which is a measure for the extractable sodium ions still present in the used sand. If the foundry sand still contains fairly large aggregates, these are initially crushed, for example, using a hammer. The foundry sand can then be further screened by a sieve which, for example, has a mesh width of 1 mm. A certain quantity of the foundry sand is then suspended in water and reacted with a defined quantity of hydrochloric acid. The amount of acid which has not reacted with the foundry sand or with the water glass adhering to the foundry sand can then be determined by back titration with NaOH. The acid consumption of the foundry sand can then be determined from the difference between the amount of acid used and the back titration.

In addition to the acid consumption, however, other parameters can also be used to track the progress of the thermal treatment. For example, the pH or the conductivity of a suspension of the foundry sand can be used. The suspension can be produced by suspending, for example, 50 g of the foundry sand in one liter of distilled water. During the thermal treatment the sand grains acquire a smooth surface. Thus, for example, the pourability of the sand can also be used as a parameter.

Properties of a moulding material mixture which has been produced from the regenerated foundry sand, for example, its processing time, or properties of a moulding produced from this moulding material mixture, for example, its density or flexural strength, can further be used for assessing the thermal treatment of the used foundry sand.

When implementing the method according to the invention for an industrial application, it is possible to proceed, for example, in such a manner that the parameters are determined by systematic series tests.

Thus, samples of the used foundry sand can be thermally processed, the treatment temperature and the treatment time being systematically varied. The acid consumption can then be determined in each case for the thermally reprocessed samples.

In each case, a moulding material mixture is produced from the individual samples and its processing time determined. Furthermore, sample bodies are produced from the moulding material mixture and their density or flexural strength determined. Then, from the sample bodies those whose properties meet the requirements are selected and then, for example the acid consumption of the relevant reprocessed foundry sand sample is used as a criterion for the thermal treatment on a larger scale.

The method according to the invention for reprocessing used foundry sands is easy to execute and requires no complex apparatus per se. The regenerated foundry sand obtained by the method according to the invention has approximately the same properties as new sand, i.e. the mouldings produced from the re-processed foundry sand have a comparable strength and a comparable density. Furthermore, a moulding material mixture produced from the regenerated foundry sand by adding water glass has approximately the same processing time as a moulding material mixture based on new sand. The method according to the invention therefore provides a simple and economical method whereby used foundry sand tainted with water-glass containing binding agent can be reprocessed, wherein the moulding material mixture or the used foundry sand contains a particulate metal oxide.

In detail, the method according to the invention for reprocessing used foundry sands tainted with water glass is carried out by:

providing a used foundry sand which is tainted with a binding agent based on water glass, to which a particulate metal oxide is added; and subjecting the used foundry sand to thermal treatment, wherein the used foundry sand is heated to a temperature of at least 200° C., whereby regenerated foundry sand is obtained.

Used foundry sand is understood per se as any foundry sand tainted with water glass which is to be supplied to reprocessing, wherein a particulate metal oxide has been added to the water glass in the previous production cycle to improve the initial strength of the casting mould. The binding agent sheath adhering to the used foundry sand therefore still contains the particulate metal oxide. The used foundry sand can also originate from a used casting mould. The used foundry mould can be present in complete form or be broken into several parts or fragments. The used foundry mould can also be crushed to such an extent that it is again present in the form of a foundry sand tainted with water glass. A used casting mould can be a casting mould which has already been used for metal casting.

However, a used casting mould can also be a casting mould which has not been used for the metal casting possibly because it is surplus or defective. Part moulds of casting moulds are likewise included. For example, permanent moulds, so-called ingot moulds, can be used for the metal casting, which are used in combination with a casting mould consisting of a foundry sand hardened with water glass. The latter can be reprocessed by the method according to the invention. A used foundry sand is also understood as an overflow sand which has, for example, remained in a supply bunker or in supply lines of a core shooter and has not yet been cured.

The water glass contained as binding agent in used foundry sand contains, according to the invention, a particulate metal oxide. In the foregoing application of the foundry sand during the production of the moulding material mixture, this metal oxide has been added to the binding agent water glass in order to improve the initial strength of a mould produced from the moulding material mixture. The used foundry sand can consist entirely of foundry sand contaminated with such a binding agent. However, it is also possible to regenerate other used foundry sands together with the used foundry sand described above Such other used foundry sands can, for example, be foundry sands contaminated with organic binding agents or foundry sands contaminated with a water-glass-based binding agent to which no particulate metal oxide has been added. In order to be able to utilise the advantages of the method according to the invention, in particular the absence of the need to mechanically separate the remaining binding agent from the sand grain after the thermal regeneration, the fraction of the used foundry sand contaminated with a water-glass-based binding agent to which a particulate metal oxide is added is preferably greater than 20 wt. %, preferably greater than 40 wt. %, particularly preferably greater than 60 wt. %, especially preferably greater than 80 wt. % relative to the quantity of foundry sand to be regenerated.

A particulate metal oxide is understood in this case to be a very fine metal oxide whose primary particles preferably have an average diameter of less than 1.5 μm, particularly preferably between 0.10 μm and 1 μm. However, larger particles can also be formed by agglomeration of the primary particles.

During the practical implementation of the method according to the invention, the predominant part of the used foundry sand accumulates during the reprocessing of used casting moulds. According to a preferred embodiment, the used foundry sand is therefore present in the form of a used casting mould which has already been used for carrying out a metal casting.

If the used foundry sand is provided in the form of a casting mould, which has already been used for the metal casting, according to a first embodiment of the method according to the invention the used foundry sand can still contain the casting. For the thermal treatment the used casting mould can therefore be used directly in the form as is obtained after the metal casting. The casting mould with the casting contained therein is subject to a thermal treatment in its entirety. For this purpose the casting mould with the casting can be transferred into a suitably dimensioned furnace. Due to the thermal treatment the cohesion between the grains of the used foundry sand is weakened. The casting mould disintegrates and the foundry sand can be collected by means of suitable devices, for example, in the furnace. The disintegration of the casting mould in the furnace can be assisted by mechanically treating the casting mould. To this end the casting mould can be shaken for example.

It is therefore not necessary to separate the casting mould from the casting for carrying out the method according to the invention. Optionally, a metallurgical improvement of the casting can be achieved concomitantly due to the thermal treatment of the used casting mould. According to a further embodiment of the method according to the invention, however, the used casting mould is initially separated from the casting and then the used casting mould is re-processed separately from the casting.

The used foundry sand tainted with water glass accumulates during the usual course of producing castings in foundries. The casting mould for the metal casting solidified with a water-glass-based binding agent can be produced in a manner known per se. The water-glass-based binding agent to which a particulate metal oxide is added can be cured by usual methods. For example, the curing can take place by treating the casting mould produced from a corresponding moulding material mixture with gaseous carbon dioxide. The casting mould can furthermore have been produced by the water glass/ester method. In this case, an ester such as, for example, ethylene glycol diacetate, diacetin, triacetin, propylene carbonate, γ-butyrolactone etc. is mixed with the foundry sand and then the water glass is added. The curing takes place by the saponification of the ester and the associated shift of the pH value. However, it is also possible for the casting mould to be hardened by removing water from the water-glass-based binding agent. The last-mentioned thermal curing is preferred. The casting mould can be constructed from a single moulding. However, it is also possible for the casting mould to be constructed of a plurality of mouldings which are optionally produced in separate operations and then assembled into a casting mould.

The casting mould can also comprise sections which have been hardened not with water glass as binding agent but, for example, with an organic binding agent such as a cold box binding agent. It is also possible that the casting mould is formed partly from permanent moulds. Those parts of the casting mould which consist of foundry sand hardened with water glass can then be reprocessed with the method according to the invention. It is also possible that the casting mould, for example, only comprises a core which consists of foundry sand hardened with water glass as binding agent whilst the mould is produced from so-called green sand. In the used casting mould, the parts containing foundry sand tainted with water glass are then separated and reprocessed by the method according to the invention.

The casting mould for the metal casting is used in the usual manner whereby after cooling the metal, a used casting mould is obtained which can be regenerated by the method according to the invention.

For the reprocessing the casting mould is heated to a temperature of at least 200° C. In this case, the entire volume of the casting mould should reach this temperature so that uniform disintegration of the casting mould is achieved. The duration for which the casting mould is subjected to a thermal treatment depends, for example, on the size of the casting mould or on the amount of water-glass-containing binding agent and can be determined by sampling. The sample taken should disintegrate to loose sand under slight mechanical action such as occurs, for example, during shaking of the casting mould. The cohesion between the grains of the foundry sand should be weakened to such an extent that the thermally treated foundry sand can easily be screened in order to separate larger aggregates or contaminants.

The duration of the thermal treatment can be selected to be relatively short for small casting moulds, particularly if the temperature is selected to be higher. For larger casting moulds, particularly if these still contain the casting, the treatment time can be selected to be significantly longer up to several hours. The time interval within which the thermal treatment is carried out is preferably selected between 5 minutes and 8 hours. The progress of the thermal regeneration can be tracked, for example, by determining the acid consumption on samples of the thermally treated foundry sand. Foundry sands such as chromite sand can themselves have basic properties so that the foundry sand influences the acid consumption. However, the relative acid consumption can be used as a parameter for the progress of the regeneration. For this purpose the acid consumption of the used foundry sand provided for the regeneration is initially determined.

For observing the regeneration the acid consumptions of the regenerated foundry sand is determined and related to the acid consumption of the used foundry sand. Due to the thermal treatment carried out in the method according to the invention, the acid consumption for the regenerated foundry sand preferably decreases by at least 10%. The thermal treatment is preferably continued until the acid consumption compared to the acid consumption of the used foundry sand has decreased by at least 20%, in particular at least 40%, particularly preferably at least 60% and especially preferably by at least 80%. The acid consumption is given in ml of consumed acid per 50 g of foundry sand, the determination being made with 0.1 N hydrochloric acid similarly to the method specified in the VDG Merkblatt P 28 (May 1979). The method for determining the acid consumption is explained in detail in the examples.

The heating of the casting mould can take place per se by any method. For example, it is possible to expose the casting mould to microwave radiation. However, other methods can also be used to heat the casting mould. It is also feasible to add an exothermal material to the foundry sand, which provides the temperature necessary for the treatment alone or in combination with other heat sources. The duration of the thermal treatment can be influenced by the temperature to which the casting mould is heated. Disintegration can already be observed at temperatures of around 200° C. The temperature is preferably selected to be higher than 250° C., in particular higher than 300° C. The upper limit for the temperature used for the thermal treatment corresponds per se to the sintering temperature of the sand. Mostly however, the temperature is limited by the design of the apparatus in which the thermal treatment is carried out. The temperature for the thermal treatment is preferably selected to be less than 1300° C., particularly preferably less than 1100° C. and especially preferably less than 1000° C. If the casting mould contains organic contaminants in addition to the water-glass-containing binding agent, the temperature is preferably selected to be sufficiently high that the organic contaminants burn.

The temperature can be kept constant during the thermal treatment. However, it is also possible to run through a temperature program during the thermal treatment in which the temperature is varied in a predefined manner. For example, the thermal treatment can initially be carried out at a relatively high temperature, e.g. at a temperature of higher than 500° C. in order to burn organic contaminants and to accelerate the disintegration of the used casting mould. The temperature can then be lowered gradually in order, for example, to adjust the acid consumption to the desired value.

As has already been explained above, according to a first embodiment the casting mould can be subjected to thermal treatment in a state in which it has not yet been separated from the casting. In this case, both the casting mould and the casting experience thermal treatment.

According to a second embodiment, the casting mould is separated from the casting before the thermal treatment. Usual methods can be used for this purpose. For example, the casting mould can be smashed by mechanical action or the casting mould can be shaken so that it disintegrates into a plurality of fragments.

In order to ensure uniform heating of the casting mould or the larger aggregates formed from this during the thermal treatment, the casting mould is preferably broken at least into coarse fragments which, for example, have a diameter of around 20 cm or less. The fragments preferably have a maximum extension of less than 10 cm, particularly preferably less than 5 cm, especially preferably less than 3 cm. Usual apparatus can be used to break the casting mould, for example, lump crushers. Fragments of corresponding size can be obtained, for example, if the casting mould is separated from the casting by means of a pneumatic hammer or a chisel or by shaking.

According to a further embodiment, a mechanical treatment of the foundry sand is carried out for grain separation before or after the thermal treatment. For this purpose, the casting mould can be ground, for example, crushed by friction or impact and the sand thus obtained can be screened. Usual apparatus can be used for this purpose such as that already used, for example, for the mechanical processing of foundry sands. For example, the foundry sand can be passed through a fluidised bed in which the sand grains are held suspended by means of a compressed air stream. The external sheath formed from water glass binding agent is abraded by the collision of the sand grains. However, the sand grains can also be deflected by means of an air stream towards a baffle plate whereupon, on impinging on the baffle plate or other sand grains, the external sheath of the sand grain formed from water glass binding agent is removed.

Preferably however, mechanical treatment of the thermally regenerated used sand is dispensed with and merely excess grain is removed by a corresponding classification. This avoids mechanical damage to the sand, for example, by splintering and smooth, readily pourable sand grains are obtained. When using foundry sand regenerated in this manner, essentially no shortening of the processing time compared to new sand is observed when this is treated again with water glass as binding agent to form a moulding material mixture.

The temperature required for the thermal treatment can initially be adjusted in any manner. In addition to methods such as treatment with microwaves, the thermal treatment is preferably carried out in such a manner that the casting mould, optionally in crushed form, is transferred into a furnace for the thermal treatment.

The furnace can be arbitrarily configured per se as long as uniform heating of the material of the casting mould is ensured. The furnace can be configured such that the thermal treatment is carried out discontinuously, that is the furnace is, for example, loaded in a batchwise manner with the, optionally crushed, casting mould and the thermally treated material is removed from the furnace again before the furnace is filled with the next batch. However, it is also possible to provide a furnace which allows continuous process control. For this purpose, the furnace can be configured, for example, in the form of a track or tunnel through which the used casting mould is transported, for example, by means of a conveyor belt. Furnaces such as are known from the thermal regeneration of used foundry sands tainted with organic binding agents can be used for the treatment of used foundry sand tainted with water glass.

It is preferably provided that the used foundry sand is moved during the thermal treatment. The movement can be effected, for example, by moving the casting mould or the fragments obtained from this about three spatial axes so that the casting mould or the fragments execute rolling movements by which means a further crushing of the casting mould or the smaller casting sand aggregates formed from this can be achieved. Such a movement can be achieved, for example, by moving the smaller foundry sand aggregates formed from the casting mould by means of an agitator or in a rotating drum. Once the used foundry sand has been crushed to such an extent that it is present in the form of a sand, the movement can also take place by holding the sand in suspension in a fluidised bed by means of a heated compressed air stream.

According to a preferred embodiment, a rotary kiln is used for the thermal treatment of the used foundry sand. It has been shown that if the casting mould is coarsely pre-crushed, extensive disintegration of the used casting mould can be achieved during passage through the rotary kiln. If larger aggregates still remain in the regenerated foundry sand after leaving the rotary kiln, these can be separated, for example, by screening.

The thermal treatment can also be carried out per se in an inert gas atmosphere. Advantageously, however, the thermal treatment is carried out whilst admitting air. This reduces the expenditure on the thermal treatment, on the one hand since no special measures need to be taken to exclude any admission of oxygen. Another advantage in the case of thermal treatment whilst admitting air is that organic contaminants contaminating the used foundry sand are burnt so that further purification is achieved.

The method according to the invention for regenerating foundry sand can be combined per se with other processing methods. Thus, for example, the thermal treatment can be preceded by a mechanical processing in which some of the water glass is abraded from the sand grains and removed by screening and/or dedusting. It is also possible to carry out a wet processing method before or after the thermal treatment according to the invention. Thus, for example, before the thermal treatment the used foundry sand can be washed with water to remove a fraction of the water glass. On account of the appreciable expenditure required by such a wet treatment, the sand must be dried after washing and the contaminated washing water must be processed, the method according to the invention is preferably carried out dry however, that is, without a wet step. Another advantage of the dry regeneration is that optionally interfering substances still remaining in the foundry sand after the thermal processing, can be firmly bound to the sand grain in the layer formed from the water glass. If the foundry sand is therefore extracted after several cycles, for example, because the grain size has increased too substantially, the sand can therefore be disposed of comparatively simply.

After the thermal treatment or before re-use as foundry sand for the production of a new casting mould, the regenerated foundry sand is preferably screened to separate larger aggregates and dedusted. Known apparatus can be used for this purpose such as are known, for example, from the mechanical regeneration of used foundry sand or the thermal regeneration of organically bound foundry sand.

The result of the regeneration can already be positively influenced by the method used to produce the casting mould for the metal casting.

In the simplest implementation of the method, water glass is substantially used as binding agent to which a fraction of a particulate metal oxide is added. In this embodiment the used casting mould is therefore provided with the casting, whereby

- a moulding material mixture is provided, which comprises at least one foundry sand and at least one water-glass-containing binding agent as well as a particulate metal oxide,
- the moulding material mixture is processed into a new casting mould and cured, and
- a metal casting is carried out with the new casting mould so that a used casting mould with a casting is obtained.

The manufacture of the new casting mould and the subsequent metal casting is carried out per se by known methods. The moulding material mixture is produced by moving the foundry sand and then adding the particulate metal oxide or the water glass in an arbitrary sequence per se. The mixture is further moved until the grains of the foundry sand are uniformly coated with the water glass.

Usual materials can be used as foundry sand for the production of casting moulds. Quartz or zirconium sand, for example, are suitable. Fibrous refractory mould base materials such as fire clay fibres are furthermore suitable. Other suitable foundry sands are, for example, olivine, chromium ore sand, vermiculite.

Synthetic mould base materials can also be used as foundry sand such as, for example, aluminum silicate hollow spheres (so-called microspheres) or spherical ceramic mould base materials known under the designation "Cerabeads®" or "Carboaccucast®". For economic reasons these synthetic mould base materials are preferably only added to the foundry sand in a fraction. Relative to the total weight of the foundry sand the synthetic mould base materials are preferably used in a fraction of less than 80 wt. %, preferably less than 60 wt. %. These spherical ceramic mould base materials contain, for example, mullite, corundum, β-cristobalite as minerals in different fractions. They contain aluminum oxide and silicon dioxide as essential fractions. Typical compositions contain, for example, $Al_2O_3$ and $SiO_2$ in approximately the same fractions. In addition, further components can be contained in fractions of <10%, such as $TiO_2$, $Fe_2O_3$. The diameter of the spherical mould base materials is preferably less that 1000 μm, in particular less than 600 μm. Synthetically produced refractory mould base materials such as mullite are also suitable ($x\ Al_2O_3.y\ SiO_2$, where x=2 to 3, y=1 to 2; ideal formula $Al_2SiO_5$) These synthetic mould base materials do not have a natural origin and can also be subjected to special shaping methods as, for example, during the production of aluminum silicate micro hollow spheres or spherical ceramic mould base materials.

According to a further embodiment of the method according to the invention, glass materials are used as refractory synthetic mould base materials. These are used particularly either as glass spheres or glass granules. Usual glasses can be used as glass, wherein glasses having a high melting point are preferred. Glass pearls and/or glass granules produced from broken glass for example are suitable. The composition of such glasses is given as an example in the following table.

TABLE composition of glasses

| Component | Broken glass | Borate glass |
|---|---|---|
| $SiO_2$ | 50-80% | 50-80% |
| $Al_2O_3$ | 0-15% | 0-15% |
| $Fe_2O_3$ | <2% | <2% |

TABLE-continued

| composition of glasses | | |
|---|---|---|
| Component | Broken glass | Borate glass |
| $M^{II}O$ | 0-25% | 0-25% |
| $M^{I}_2O$ | 5-25% | 1-10% |
| $B_2O_2$ | | <15% |
| Other | <10% | <10% |

$M^{II}$: alkaline earth metal, e.g. Mg, Ca, Ba
$M^{I}$: alkali metal e.g. Na, K In addition to the glasses given in the Table, other glasses can also be used whose content of the aforesaid compound lies outside the said ranges. Special glasses can also be used which contain other elements or their oxides in addition to said oxides.

The diameter of the glass spheres is preferably 1 to 1000 μm, preferably 5 to 500 μm and particularly preferably 10 to 400 μm.

In casting experiments using aluminum, it was found that when using synthetic mould base materials, primarily glass pearls, glass granules or microspheres, less used foundry sand remains adhering to the metal surface after the casting than when using pure quartz sand. The use of synthetic mould base materials therefore makes it possible to produce smooth casting surfaces whereby expensive after-treatment by jets is not necessary or at least to a considerably lesser extent.

It is not necessary to form the entire foundry sand from the synthetic mould base materials. The preferred fraction of the synthetic mould base material is at least about 3 wt. %, particularly preferably at least 5 wt. %, especially preferably at least 10 wt. %, preferably at least about 15 wt. %, particularly preferably at least about 20 wt. %, relative to the total quantity of foundry sand.

The foundry sand preferably exhibits a pourable state so that the moulding material mixture can be processed in usual core shooters. The foundry sand can be formed by new sand which has not yet been used for metal casting. Preferably however, the foundry sand used to produce the moulding material mixture comprises at least a fraction of reprocessed foundry sand, in particular a reprocessed foundry sand such as is obtained with the method according to the invention. The fraction of reprocessed foundry sand can be arbitrarily selected per se between 0 and 100%. The method is particularly preferably executed in such a manner that only the fraction of the foundry sand that is lost during the reprocessing according to the invention for example, during the screening, is made up by new sand or another suitable sand. A thermally regenerated sand originally bound with an organic binding agent, for example, is suitable. Mechanically regenerated foundry sands can also be used provided that the organic binding agent still adhering to them does not accelerate the curing of the water glass binding agent. For example, mechanically regenerated foundry sands still tainted with organic binding agents which were cured acidically are unsuitable. The method according to the invention therefore does not necessarily require that a separate cycle is set up for foundry sand bound with water glass.

The moulding material mixture contains a water-glass-based binding agent as a further component. Usual water glasses such as have conventionally been used as binding agents in moulding material mixtures can be used as water glass. These water glasses contain dissolved sodium or potassium silicates and can be produced by dissolving glass-like potassium and sodium silicates in water. The water glass preferably has an $SiO_2/M_2O$ modulus in the range of 1.6 to 4.0, in particular 2.0 to 3.5, wherein M stands for sodium and/or potassium. The water glasses preferably have a solid fraction in the range of 30 to 60 wt. %. The solid fraction is related to the quantity of $SiO_2$ and $M_2O$ contained in the water glass.

During the production of the moulding material mixture, the procedure is generally adopted that the foundry sand is firstly provided and then the binding agent and the particulate metal oxide are added whilst agitating. The binding agent can consist only of water glass. However, it is also possible to add additives to the water glass or the foundry sand which positively influence the properties of the casting mould or the regenerated foundry sand. The additives can be added in solid or in liquid form, for example, as a solution, in particular as an aqueous solution. Suitable additives are described further below.

During the production of the moulding material mixture, the foundry sand is placed in a mixer and if provided, the solid component(s) of the binding agent are preferably added firstly and mixed with the foundry sand. The mixing time is selected so that thorough mixing of the foundry sand and solid binding agent components takes place. The mixing time is dependent on the quantity of moulding material mixture to be produced and on the mixing unit used. The mixing time is preferably selected between 5 seconds and 5 minutes. The liquid component of the binding agent is then added whilst preferably continuing to move the mixture and then the mixture is mixed further until a uniform layer of the binding agent has formed on the grains of the foundry sand. Here also, the mixing time is dependent on the quantity of moulding material mixture to be produced and on the mixing unit used. The duration for the mixing process is preferably selected between 5 seconds and 5 minutes. A liquid component is understood to be both a mixture of different liquid components and also the entirety of all the liquid individual components, wherein the latter can also be added individually. Likewise a solid component is understood to be both a mixture of individual or all the solid components and also the entirety of all the solid individual components, wherein the latter can be added jointly or successively to the moulding material mixture.

It is also possible to firstly add the liquid component of the binding agent to the foundry sand and only then supply the solid component to the mixture, if provided. According to one embodiment, firstly 0.05 to 0.3% water, relative to the weight of the foundry sand is added to the foundry sand and only then are the solid and liquid components of the binding agent added. In this embodiment, a surprising positive effect on the processing time of the moulding material mixture can be achieved. The inventors assume that the dehydrating effect of the solid components of the binding agent is reduced in this way and the curing process thereby delayed.

The moulding material mixture is then brought into the desired form. In this case, usual methods are used for the shaping. For example, the moulding material mixture can be shot into the moulding tool by means of a core shooter with the aid of compressed air. The moulded moulding material mixture is then cured. All the usual methods per se can be used for this purpose. Thus, the mould can be gasified with carbon dioxide in order to harden the moulding material mixture. This gasification is preferably carried out at room temperature, i.e. in a cold tool. The gasification time depends inter alia on the size of the moulding to be produced and is usually selected to be in the range of 10 seconds to 2 minutes. For larger mouldings longer gasification times are also possible, for example, up to 5 minutes. Shorter or longer gasification times are, however, also possible.

However, the curing of the moulding can also be effected by means of the water glass/ester method in which the curing is achieved by saponification of an ester and an associated shift of the pH.

The curing of the moulding can preferably take place merely by supplying heat whereby the water container in the binding agent is evaporated. The heating can take place, for example, in the moulding tool. For this purpose, the moulding tool is heated, preferably to temperatures of up to 300° C., particularly preferably to a temperature in the range of 100 to 250° C. It is possible to completely cure the casting mould in the moulding tool. However, it is also possible to cure the casting mould merely in its edge zone so that it has sufficient strength to be able to be removed from the moulding tool. The casting mould can optionally then be completely cured by removing further water from said mould. This can take place, for example, as described, in a furnace. The removal of water can be accomplished, for example, by evaporating the water at reduced pressure.

The curing of the casting moulds can be accelerated by blowing heated air into the moulding tool. In this embodiment of the method, a rapid removal of the water contained in the binding agent is achieved whereby the casting mould is hardened in time intervals suitable for an industrial application. The temperature of the blown-in air is preferably 100° C. to 180° C., particularly preferably 120° C. to 150° C. The flow rate of the heated air is preferably adjusted so that the curing of the casting mould takes place in time intervals suitable for an industrial application. The time intervals depend on the size of the casting moulds produced. Curing in a time interval of less than 5 minutes, preferably less than 2 minutes is strived for. In the case of very large casting moulds however, longer time intervals may be necessary.

The removal of water from the moulding material mixture can also be accomplished by heating the moulding material mixture by microwave irradiation. However, the microwave irradiation is preferably carried out after the casting mould has been removed from the moulding tool. For this purpose, however the casting mould must already have sufficient strength. As has already been explained, this can be effected, for example, by curing at least an outer shell of the casting mould in the moulding tool.

If the casting mould consists of a plurality of partial moulds, these are suitably assembled to form the casting mould, wherein supply lines and compensating reservoirs can also be attached to the casting mould.

The casting mould is then used in the usual manner for the metal casting. The metal casting can be carried out per se with any metal. An iron casting or an aluminum casting, for example, is suitable. After the solidification or cooling of the metal, the casting mould is then reprocessed in the manner already described by thermal treatment.

The properties of the casting mould as well as those of the regenerated sand can be improved by adding additives to the moulding material mixture.

As has already been explained, a particulate metal oxide is added to the water glass used as binding agent. The particulate metal oxide does not correspond to the foundry sand. It has a smaller average particle size than the foundry sand.

According to one embodiment, the moulding material mixture contains a fraction of a particulate metal oxide which is selected from the group of silicon dioxide, aluminum oxide, titanium oxide and zinc oxide. The strength of the casting mould can be influenced by adding this particulate metal oxide.

The average primary particle size of the particulate metal oxide can be between 0.10 μm and 1 μm. On account of the agglomeration of the primary particles however, the particle size of the metal oxides is preferably less than 300 μm, preferably less than 200 μm, particularly preferably less than 100 μm. This lies preferably in the range of 5 to 90 μm, particularly preferably 10 to 80 μm and quite particularly preferably in the range of 15 to 50 μm. The particle size can be determined, for example, by screen analysis. The screen residue on a screen having a mesh width of 63 μm is particularly preferably less than 10 wt. %, preferably less than 8 wt. %.

Silicon dioxide is particularly preferably used as particulate metal oxide, synthetically produced amorphous silicon dioxide being particularly preferred here.

Precipitated silicic acid and/or pyrogenic silicic acid is preferably used as particulate silicon dioxide. Precipitated silicic acid is obtained by reaction of an aqueous alkali silicate solution with mineral acids. The accumulating deposit is then separated, dried and ground. Pyrogenic silicic acids are understood as silicic acids which are obtained by coagulation from the gas phase at high temperatures. Pyrogenic silicic acid can be produced, for example, by flame hydrolysis of silicon tetrachloride or in an arc furnace by reduction of quartz sand with coke or anthracite to silicon monoxide gas followed by oxidation to silicon dioxide.

The pyrogenic silicic acids produced by the arc furnace method can still contain carbon. Precipitated silicic acid and pyrogenic silicic acid are equally well suited for the moulding material mixture according to the invention. These silicic acids are subsequently designated as "synthetic amorphous silicon dioxide".

The inventors assume that the strongly alkaline water glass can react with the silanol groups located on the surface of the synthetically produced amorphous silicon dioxide and during the evaporation of the water an intensive bond is produced between the silicon dioxide and the then solid water glass.

According to a further embodiment, at least one organic additive is added to the moulding material mixture.

An organic additive is preferably used which has a melting point in the range of 40 to 180°, preferably 50 to 175° C., i.e. is solid at room temperature. Organic additives are understood in this case as compounds whose molecular framework is predominantly constructed of carbon atoms, i.e., for example, organic polymers. The quality of the surface of the casting can be further improved by adding organic additives. The mechanism of action of the organic additive is not clarified. Without wishing to be bound to this theory, the inventors assume, however, that at least some of the organic additives burn during the casting process and a thin gas cushion is thereby formed between liquid metal and the foundry sand forming the wall of the casting mould and thus prevents a reaction between liquid metal and foundry sand. The inventors further assume that in the reducing atmosphere prevailing during casting some of the organic additive forms a thin layer of so-called glossy carbon which likewise prevents a reaction between metal and foundry sand. An increase in the strength of the casting mould after the curing can also be achieved as a further advantageous effect due to the addition of organic additives.

The organic additives are preferably added in a quantity of 0.01 to 1.5 wt. %, particularly preferably 0.05 to 1.3 wt. %, particularly preferably 0.1 to 1.0 wt. %, in each case relative to the foundry sand.

An improvement in the surface of the casting can be achieved with very different organic additives. Suitable organic additives are, for example, phenol formaldehyde resins such as, for example, novolac, epoxy resins such as, for example, bisphenol-A-epoxy resins, bisphenol-F-epoxy resins or epoxided novolacs, polyols such as, for example, polyethylene glycols or polypropylene glycols, polyolefins such as, for example, polyethylene or polypropylene, copolymers of olefins such as ethylene or propylene and other comonomers such as vinyl acetate, polyamides such as, for example, polyamide-6, polyamide-12 or polyamide-6,6, natural resins such as, for example, balsam resin, fatty acids such as, for example, stearic acid, fatty acid esters such as, for example, cetyl palmitate, fatty acid amides such as, for example, ethylene diamine bis stearamide as well as metal soaps such as, for example, stearates or oleates of mono- to trivalent metals. The organic additives can be contained as pure substance or as a mixture of various organic compounds.

According to a further embodiment, at least one carbohydrate is used as organic additive. By adding carbohydrates, the casting mould acquires a high strength both directly after manufacture and also during longer storage. Furthermore, after the metal casting, a casting having a very high surface quality is achieved so that after removing the casting mould, only slight reprocessing of the surface of the casting is required. This is an essential advantage since the costs for producing a casting can be reduced significantly in this way. If carbohydrates are used as organic additive, significantly less production of smoke is observed during casting compared to other organic additives such as acrylic resins, polystyrene, polyvinyl esters or polyalkyl compounds so that the loading on the workplace for those working there can be substantially reduced.

In this case, both mono- or disaccharides and also higher-molecular oligo- or polysaccharides can be used. The carbohydrates can be used both as a single compound and as a mixture of different carbohydrates. No excessive requirements are imposed per se on the purity of the carbohydrates used. It is sufficient if the carbohydrates, relative to the dry weight, are present in a purity of more than 80 wt. %, particularly preferably more than 90 wt. %, particularly preferably more than 95 wt. %, in each case relative to the dry weight. The monosaccharide units of the carbohydrates can be arbitrarily linked per se. The carbohydrates preferably have a linear structure, for example, an α- or β-glycosidic 1,4-link. However, the carbohydrates can also be completely or partially 1,6-linked such as, for example amylopectin which has up to 6% α-1,6 bonds.

The quantity of carbohydrate can be selected to be relatively small in order to still observe a significant effect in the strength of the casting moulds before the casting or a significant improvement in the quality of the surface. The fraction of the carbohydrate relative to the foundry sand is preferably selected in the range of 0.1 to 10 wt. %, particularly preferably 0.02 to 5 wt. %, especially preferably 0.05 to 2.5 wt. % and quite particular preferably in the range of 0.1 to 0.5 wt. %. Even small fractions of carbohydrates in the range of about 0.1 wt. % lead to significant effects.

According to a further embodiment of the invention, the carbohydrate is used in underivatised form. Such carbohydrates can be favourably obtained from natural sources such as plants, for example cereals or potatoes. The molecular weight of these carbohydrates obtained from natural sources can be reduced, for example, by chemical or enzymatic hydrolysis in order to improve, for example, the solubility in water. In addition to underivatised carbohydrates which are therefore constructed only of carbon, oxygen and hydrogen, however, derivatised carbohydrates can also be used in which, for example some or all the hydroxy groups are etherised with, for example, alkyl groups. Suitable derivatised carbohydrates are, for example, ethyl cellulose or carboxymethyl cellulose.

Low-molecular hydrocarbons such as mono- or disaccharides can also be used per se. Examples are glucose or saccharose. However, the advantageous effects are particularly observed when using oligo- or polysaccharides. An oligo- or polysaccharide it therefore particularly preferably used as carbohydrate.

In this case, it is preferred that the oligo- or polysaccharide has a molar mass in the range of 1000 to 100,000 g/mol, preferably 2000 or 30,000 g/mol. In particular if the carbohydrate has a molar mass in the range of 5000 to 20,000 g/mol, a significant increase in the strength of the casting mould is observed so that the casting mould can easily be removed from the mould during manufacture and transported. During longer storage the casting mould also shows a very good strength so that storage of casting moulds which is required for series production of castings, even over several days with air moisture being admitted is easily possible. The resistance under the action of water, as is unavoidable for example, when applying a facing to the casting mould, is also very good.

The polysaccharide is preferably constructed of glucose units, these particularly preferably being α- or β-glycosidically 1,4 linked. However, it is also possible to use carbohydrate compounds containing other monosaccharides apart from glucose, such as galactose or fructose, as an organic additive. Examples of suitable carbohydrates are lactose (α- or β-1,4-linked disaccharide of galactose and glucose) and saccharose (disaccharide of α-glucose and β-fructose).

The carbohydrate is particularly preferably selected from the group of cellulose, starch and dextrines as well as derivatives of these carbohydrates. Suitable derivatives are, for example, derivatives completely or partially etherised with alkyl groups. However, other derivatisations can also be carried out, for example, esterifications with inorganic or organic acids.

A further optimisation of the stability of the casting mould as well as the surface of the casting can be achieved if special carbohydrates and in this case particularly preferably starches, dextrines (hydrolysate product of starches) and derivatives thereof are used as additives for the moulding material mixture. In particular, the naturally occurring starches such as potato, maize, rice, pea, banana, horse chestnut or wheat starch can be used as starches. However, it is also possible to use modified starches such as, for example, swelling starch, thin-boiling starch, oxidised starch, citrate starch, acetate starch, starch ether, starch ester or starch phosphate. There is no restriction in the choice of starch per se. The starch can, for example, be low-viscosity, medium-viscosity or high-viscosity, cationic or anionic, cold water soluble or hot water soluble. The dextrin is particularly preferably selected from the group of potato dextrin, maize dextrin, yellow dextrin, white dextrin, borax dextrin, cyclodextrin and maltodextrin.

Particularly when manufacturing casting moulds having very thin-walled sections, the moulding material mixture preferably additionally comprises a phosphorus-containing compound. In this case, both organic and inorganic phosphorus compounds can be used per se. In order not to trigger any undesirable side reactions during the metal casting, it is further preferred that the phosphorus in the phosphorus-containing compounds in preferably present in the oxidation state V. The stability of the casting mould can be further increased by adding phosphorus-containing compounds. This is particularly of great importance if the liquid metal impinges upon a sloping surface in the metal casting and exerts a high erosion effect there due to the high metallostatic pressure or can lead to deformations particularly of thin-walled sections of the casting mould.

The phosphorus-containing compound is preferably present in the form of a phosphate or phosphorus oxide. In this case, the phosphate can be present as an alkali or as an alkaline earth metal phosphate, the sodium salts being particularly preferred. Ammonium phosphates or phosphates of other metal ions can also be used per se. However, the alkali or alkaline earth metal phosphates specified as preferred are easily accessible and available inexpensively in arbitrary quantities per se.

If the phosphorus-containing compound is added to the moulding material mixture in the form of a phosphorus oxide, the phosphorus oxide is preferably present in the form of phosphorus pentoxide. However, phosphorus trioxide and phosphorus tetroxide can also be used.

According to a further embodiment, the phosphorus-containing compound can be added to the moulding material mixture in the form of salts of the fluorophosphoric acids. Particularly preferred in this case are the salts of monofluorophosphoric acid. The sodium salt is especially preferred.

According to a preferred embodiment, organic phosphates are added to the moulding material mixture as phosphorus-containing compounds. Alkyl or aryl phosphates are preferred in this case. The alkyl groups preferably comprise 1 to 10 carbon atoms and can be straight-chain or branched. The aryl groups preferably comprise 6 to 18 carbon atoms, wherein the aryl groups can also be substituted by alkyl groups. Particularly preferred are phosphate compounds derived from monomeric or polymeric carbohydrates such as possibly glucose, cellulose or starch. The use of a phosphorus-containing organic component as additive is advantageous in two respects. On the one hand, the necessary thermal stability of the casting mould can be achieved by the phosphorus fraction and on the other hand, the surface quality of the corresponding casting is positively influenced by the organic fraction.

Both orthophosphates and also polyphosphates, pyrophosphates or metaphosphates can be used as phosphates. The phosphates can be produced, for example, by neutralisation of the corresponding acids with a corresponding base, for example, an alkali metal or an alkaline earth metal base such as NaOH, in which case not necessarily all the negative charges of the phosphate ion need be saturated by metal ions. Both the metal phosphates and also the metal hydrogen phosphates and the metal dihydrogen phosphates can be used such as, for example, $Na_3PO_4$, $Na_2HPO_4$ and $NaH_2PO_4$. Likewise the anhydrous phosphates and hydrates of the phosphates can be used. The phosphates can be incorporated in the moulding material mixture in crystalline and in amorphous form.

Polyphosphates are understood in particular as linear phosphates which comprise more than one phosphorus atom, wherein the phosphorus atoms are each linked via oxygen bridges. Polyphosphates are obtained by condensation of orthophosphate ions with elimination of water so that a linear chain of $PO_4$ tetrahedra is obtained, each linked via corners. Polyphosphates have the general formula $(O(PO_3)_n)^{(n+2)-}$, wherein n corresponds to the chain length. A polyphosphate can comprise up to several hundred $PO_4$ tetrahedra. Preferably however, polyphosphates with shorter chain lengths are used. Preferably n has values of 2 to 100, particularly preferably 5 to 50. Higher condensed polyphosphates can also be used, i.e. polyphosphates in which the $PO_4$ tetrahedra are interlinked via more than two corners and therefore exhibit polymerisation in two or three dimensions.

Metaphosphates are understood as cyclic structures which are constructed of $PO_4$ tetrahedra each linked via corners. Metaphosphates have the general formula $((PO_3)_n)^{n-}$, wherein n is at least 3. Preferably n has values of 3 to 10.

Both individual phosphates can be used and also mixtures of various phosphates and/or phosphorus oxides.

The preferred fraction of the phosphorus-containing compound, related to the foundry sand, is between 0.05 and 1.0 wt. %. With a fraction of less than 0.05 wt. %, no significant influence on the dimensional stability of the casting mould can be established. If the phosphate fraction exceeds 1.0 wt. %, the hot strength of the casting mould decreases strongly. The fraction of the phosphorus-containing compound is preferably selected between 0.10 and 0.5 wt. %. The phosphorus-containing compound preferably contains between 0.5 and 90 wt. % phosphorus, calculated as $P_2O_5$. If inorganic phosphorus compounds are used, these preferably contain 40 to 90 wt. %, particularly preferably 50 to 80 wt. % phosphorus, calculated as $P_2O_5$. If organic phosphorus compounds are used, these preferably contain 0.5 to 30 wt. %, particularly preferably 1 to 20 wt. % phosphorus, calculated as $P_2O_5$.

The phosphorus-containing compound can be added to the moulding material mixture in solid or dissolved form per se. The phosphorus-containing compound is preferably added to the moulding material mixture as a solid. If the phosphorus-containing compound is added in dissolved form, water is preferred as the solvent.

The moulding material mixture is an intensive mixture of water glass, foundry sand and optionally the aforesaid constituents. In this case, the particles of the foundry sand are preferably covered with a layer of binding agent. A firm cohesion between the particles of the foundry sand can then be achieved by evaporating the water present in the binding agent (approx. 40-70 wt. % relative to the weight of the binding agent).

The binding agent, i.e. the water glass as well as optionally the particulate metal oxide, in particular synthetic amorphous silicon dioxide and/or the organic additive is preferably contained in the moulding material mixture in a fraction of less than 20 wt. %, particularly preferably in a range of 1 to 15 wt. %. The fraction of the binding agents relates in this case to the solid fraction of the binding agent.

If pure foundry sand is used such as, for example, quartz sand, the binding agent is preferably present in a fraction of less than 10 wt. %, preferably less than 8 wt. %, particularly preferably less than 5 wt. %. If the foundry sand contains further refractory mould base materials having a low density such as, for example, micro hollow spheres, the percentage fraction of the binding agent is increased accordingly.

The particulate metal oxide, in particular the synthetic amorphous silicon dioxide, relative to the total weight of the binding agent, is preferably contained in a fraction of 2 to 80 wt. %, preferably between 3 and 60 wt. %, particularly preferably between 4 and 50 wt. %.

The ratio of water glass to particulate metal oxide, in particular synthetic amorphous silicon dioxide, can be varied within further ranges. This offers the advantage of improving the initial strength of the casting mould, i.e. the strength immediately after removal from the hot tool, and the moisture resistance, without substantially influencing the final strengths, i.e., the strengths after cooling the casting mould, compared with a water glass binding agent without amorphous silicon dioxide. This is primarily of great interest in light metal casting. On the one hand, high initial strengths are desirable so that after production of the casting mould, this can be transported easily or combined with other casting moulds. On the other hand, the final strength after curing should not be too high to avoid difficulties with binder decay after the casting, i.e. the foundry sand should be able to be removed easily from hollow cavities of the casting mould after the casting.

In one embodiment of the invention, the foundry sand contained in the moulding material mixture can contain at least a fraction of micro hollow spheres. The diameter of the micro hollow spheres is normally in the range of 5 to 500 μm, preferably in the range of 10 to 350 μm, and the thickness of the shell usually lies in the range of 5 to 15% of the diameter of the microspheres. These microspheres have a very low specific weight so that the casting moulds produced using micro hollow spheres have a low weight. The insulating effect of the micro hollow spheres is particularly advantageous. The micro hollow spheres are therefore used particularly for the production of casting moulds when these are intended to have an increased insulating effect. Such casting moulds are for example the feeders already described in the introduction which act as a compensating reservoir and contain liquid metal, wherein the metal should be held in a liquid state until the metal poured into the hollow mould has solidified. Another area of application of casting moulds containing micro hollow spheres is, for example, sections of a casting mould which correspond to particularly thin-walled sections of the finished casting mould. The insulating effect of the micro hollow spheres ensures that the metal in the thin-walled sections does not solidify prematurely and thereby block the paths inside the casting mould.

If micro hollow spheres are used, due to the low density of these micro hollow spheres, the binding agent is preferably used in a fraction in the range of preferably less than 20 wt. %, particularly preferably in the range of 10 to 18 wt. %. The values relate to the solid fraction of the binding agent.

The micro hollow spheres preferably consist of an aluminum silicate. These aluminum silicate micro hollow spheres preferably have an aluminum oxide content of more than 20 wt. % but can have a content of more than 40 wt. %. Such micro hollow spheres are supplied, for example, by Omega Minerals Germany GmbH, Norderstedt, under the designations Omega-Spheres® SG with an aluminum oxide content of about 28-33%, Omega-Spheres® WSG with an aluminum oxide content of about 35-39% and E-spheres® with an aluminum oxide content of about 435. Corresponding products are available from the PQ Corporation (USA) under the designation "Extendospheres®".

According to a further embodiment, micro hollow spheres are used as refractory mould base material which are constructed from glass.

According to a particularly preferred embodiment, the micro hollow spheres consist of a borosilicate glass. The borosilicate glass in this case has a boron fraction, calculated as $B_2O_3$, of more than 3 wt. %. The fraction of micro hollow spheres is preferably selected to be less than 20 wt. %, relative to the moulding material mixture. When using borosilicate glass micro hollow spheres, a small fraction is preferably selected. This is preferably less than 5 wt. %, preferably less than 3 wt. % and is particularly preferably in the range of 0.01 to 2 wt. %.

As has already been explained, the moulding material mixture in one embodiment contains at least a fraction of glass granules and/or glass pearls as refractory mould base material. It is also possible to configure the moulding material mixture as an exothermic moulding material mixture which is suitable, for example, for producing exothermic feeders. For this purpose, the moulding material mixture contains an oxidizable metal and a suitable oxidising agent. Relative to the total mass of the moulding material mixture, the oxidizable metals preferably form a fraction of 15 to 35 wt. %. The oxidising agent is preferably added in a fraction of 20 to 30 wt. % relative to the moulding material mixture. Suitable oxidizable metals are, for example, aluminum or magnesium. Suitable oxidising agents are, for example, iron oxide or potassium nitrate. If the used foundry sand contains residues of exothermic feeders, these are preferably removed before the thermal treatment. If the exothermic feeders are not completely burnt away, there is otherwise a risk of ignition during the thermal treatment.

Binding agents containing water have a poorer flowability compared with binding agents based on organic solvents. This means that moulding tools with narrow passages and a plurality of deflections are more difficult to fill. As a consequence, the casting moulds have sections with inadequate compaction which in turn can lead to casting defects during casting. According to an advantageous embodiment, the moulding material mixture contains a fraction of lubricants, preferably flake-shaped lubricants, in particular graphite, $MoS_2$, talc and/or pyrophillite. In addition to the flake-shaped lubricants, however, liquid lubricants can also be used such as mineral oils or silicone oils. It has been shown that when such lubricants are added, in particular graphite, complex moulds with thin-walled sections can be produced, wherein the casting moulds have a uniformly high density and strength throughout so that substantially no casting defects are observed during casting. The quantity of added flake-shaped lubricant, particularly graphite is preferably 0.05 wt. % to 1 wt. %, related to the foundry sand.

In addition to said constituents, the moulding material mixture can comprise further additives. For example, internal release agents can be added which facilitate the release of the casting moulds from the moulding tool. Suitable internal release agents are, for example, calcium stearate, fatty acid ester, wax, natural resins or special alkyd resins. Silanes can also be added to the moulding material mixture according to the invention.

According to a further preferred embodiment, the moulding material mixture contains a fraction of at least one silane. Suitable silanes are, for example, aminosilanes, epoxysilanes, mercaptosilanes, hydroxysilanes, methacrylsilanes, ureidosilanes and polysiloxanes. Examples for suitable silanes are γ-aminopropyl trimethoxysilane, γ-hydroxypropyl trimethoxysilane, 3-ureidopropyl triethoxysilane, γ-mercaptopropyl trimethoxysilane, γ-glycidoxypropyl trimethoxysilane, β-(3,4-epoxycyclohexyl) trimethoxysilane, 3-methacryloxypropyl trimethoxysilane and N-β(aminoethyl)-γ-aminopropyl trimethoxysilane.

Typically, about 5-50% silane is used relative to the particulate metal oxide, preferably about 7-45%, particularly preferably about 10-40%.

The additives described above can be added per se in any form to the moulding material mixture. They can be added individually or as a mixture. They can be added in the form of a solid but also in the form of solutions, pastes or dispersions. If the addition is made as a solution, paste or dispersion, water is preferred as solvent. It is also possible to use the water glass used as binding agent as a solution or dispersion medium for the additives.

According to a preferred embodiment, the binding agent is provided as a two-component system, wherein a first liquid component contains the water glass and a second solid component contains the particulate metal oxide. The solid component can furthermore, for example, comprise the phosphate as well as optionally a lubricant such as a flake-shaped lubricant. If the carbohydrate is added in solid form to the moulding material mixture, this can also be added to the solid component.

Water-soluble organic additives can be used in the form of an aqueous solution. If the organic additives are soluble in the binding agent and are storage-stable without decomposition for several months therein, they can be dissolved in the binding agent and thus added jointly with this to the foundry sand. Water-insoluble additives can be used in the form of a dispersion or a paste. The dispersions or pastes preferably contain water as dispersing medium. Solutions or pastes of the organic additives per se can also be produced in organic solvents. However, if a solvent is used for adding the organic additive, water is preferably used. The addition of the organic additives is preferably made as powder or as short fibres, the average particle size or the fibre length preferably being selected so that it does not exceed the size of the foundry sand particles. The organic additives can preferably be screened by a screen having a mesh width of about 0.3 mm. In order to reduce the number of components added to the foundry sand, the particulate metal oxide and the organic additive or additives are preferably not added separately to the mould sand but pre-mixed.

If the moulding material mixture contains silanes or siloxanes, these are usually added in the form that they are previously incorporated in the binding agent. However, the silanes or siloxanes can also be added to the foundry sand as separate components. It is particularly advantageous however to silanise the particulate metal oxide, i.e. to mix the metal oxide with the silane or siloxane so that its surface is provided with a thin silane or siloxane layer. If the particulate metal oxide thus pretreated is used, increased strengths are found compared with the untreated metal oxide as well as an improved resistance to high air humidity. If, as described, an organic additive is added to the moulding material mixture or the particulate metal oxide, it is expedient to do this before the silanisation.

The reprocessed foundry sand obtained by the method according to the invention approximately attains the properties of new sand and can be used for producing mouldings having a comparable density and strength to mouldings which have been produced from new sand. The invention therefore relates to a reprocessed foundry sand such as is obtained by the method described above. This method consists of a sand grain surrounded by a thin sheath of a glass layer. The layer thickness is preferably between 0.1 and 2 μm.

The invention is explained in detail hereinafter with reference to examples.

Measurement Methods Used:

AFS number: The AFS number was determined in accordance with VDG Merkblatt P 27 (German Foundrymens' Association, Düsseldorf, October 1999).

Average grain size: The average grain size was determined in accordance with VDG Merkblatt P 27 (German Foundrymens' Association, Düsseldorf, October 1999).

Acid consumption: The acid consumption was determined by analogy with the regulations from the VDG Merkblatt P 28 (German Foundrymens' Association, Düsseldorf, May 1979).

Reagents and Equipment:

Hydrochloric acid 0.1 N

Sodium hydroxide solution 0.1 N

Methyl orange 0.1%

250 ml plastic bottles (polyethylene)

Calibrated full pipettes

Conducting the Determination:

If the foundry sand still contains larger aggregates of bound foundry sand, these aggregates are crushed, for example, with the aid of a hammer and the foundry sand screened through a screen having a mesh width of 1 mm.

50 ml of distilled water and 50 ml of 0.1 N hydrochloric acid are pipetted into the plastic bottle. Then 50.0 g of the foundry sand to be studied is then added to the bottle using a funnel and the bottle is closed. In the first 5 minutes, the bottle is agitated vigorously every minute for 5 minutes, then every 30 minutes for 5 minutes at a time. After each agitation, the sand is left to settle for a few seconds and the sand adhering to the bottle wall is flushed downwards by briefly tilting. During the rest periods the bottle remains standing at room temperature. After 3 hours, the mixture is filtered through a medium filter (Weissband, 12.5 cm diameter). The funnel and the beaker used for collecting must be dry. The first few milliliters of the filtrate are discarded. 50 ml of the filtrate is pipetted into a 300 ml titrating flask and mixed with 3 drops of methyl orange as indicator. Then the mixture is titrated from red to yellow with a 0.1 n sodium hydroxide solution.

Calculation:

(25.0 ml hydrochloric acid 0.1 N−consumed ml sodium hydroxide solution 0.1 N)×2=ml acid consumption/50 g foundry sand

EXAMPLES

1. Production and Curing of Moulding Material Mixtures Bound with Water Glass 1.1 Moulding Material Mixture 1

100 parts by weight of quartz sand H 32 (Quartzwerke GmbH, Frechen) were vigorously mixed with 2.0 parts by weight of the commercially available alkali water glass binder INOTEC® EP 3973 (Ashland-Südchemie—Kernfest GmbH) and the moulding material mixture was cured at a temperature of 200° C.

1.2 Moulding Material Mixture 2

100 parts by weight of quartz sand H 32 was first vigorously mixed with 0.5 parts by weight of amorphous silicon dioxide (Elkem Microsilica 971) and then mixed with 2.0 parts by weight of the commercially available alkali water glass binder INOTEC® EP 3973 (Ashland-Südchemie—Kernfest GmbH) and the moulding material mixture was cured at a temperature of 200° C.

2. Regeneration of the Cured Moulding Material Mixtures Bound with Water Glass 2.1 Mechanical Regeneration (Comparison, not According to the Invention)

The cured moulding material mixtures produced according to 1.1 and 1.2 are firstly coarsely crushed and then mechanically regenerated in a regeneration system from Neuhof Giesserei—und Fördertechnik GmbH, Freudenberg, which operates according to the impact principle and is provided with a dust removal system, and the dust fractions produced are removed.

The analytical data, AFS number, average grain size and acid consumption of the two regenerates are listed in Table 1. For comparison, the granulometric data of the initial mould material H32 and the acid consumption of the two cured moulding material mixtures before regeneration are given. The acid consumption is a measure for the alkalinity of a foundry sand.

TABLE 1

| | H32 | Moulding material mixture 1 | Moulding material mixture 2 | Mechanical regen-erate 1[a] | Mechanical regen-erate 2[b] |
|---|---|---|---|---|---|
| AFS number | 45 | — | — | 44 | 45 |
| Average grain size (mm) | 0.32 | — | — | 0.34 | 0.32 |
| Acid consumption (ml/50 mg of moulding material) | — | 43.7 | 41.0 | 38.7 | 32.9 |

[a]Starting from moulding material mixture 1
[b]Starting from moulding material mixture 2

2.2 Thermal Regeneration

Approximately 6 kg each of mechanical regenerates 1 and 2 were exposed to temperatures of 350° C. or 900° C. in a muffle furnace from Nabertherm GmbH, Lilienthal.

The cured moulding material mixtures 1 and 2 were thermally treated in the same way at 900° C. after coarse crushing without preceding mechanical regeneration.

After cooling, the sands were used without screening for the further tests. For this reason the AFS number and the average grain size were not determined.

The acid consumption of the thermal regenerates were determined analytically (see Table 2).

TABLE 2

| Thermal regenerate | Starting material | Treatment time (h) | Treatment temperature (° C.) | Acid consumption (ml/50 g) |
|---|---|---|---|---|
| 1 | Mechanical regenerate 1 | 3 | 900 | 2.8 |
| 2 | Mechanical regenerate 1 | 3 | 350 | 18.2 |
| 3 | Mechanical regenerate 1 | 6 | 350 | 9.9 |
| 4 | Cured moulding material mixture 1* | 3 | 900 | 4.3 |
| 5 | Mechanical regenerate 2 | 3 | 900 | 2.0 |
| 6 | Mechanical regenerate 2 | 3 | 350 | 14.4 |
| 7 | Mechanical regenerate 2 | 6 | 350 | 7.8 |
| 8 | Cured moulding material mixture 2* | 3 | 900 | 3.7 |

*Sample was crushed but not mechanically regenerated.

3. Core Production Using Regenerated Foundry Sands 3.1 Mechanically Regenerated Foundry Sands (Comparison)

So-called Georg Fischer test bars were produced for testing the mechanically regenerated foundry sands. Georg Fischer test bars are understood as rectangular test bars having dimensions of 150 mm×22.26 mm×22.36 mm.

The composition of the moulding material mixtures is given in Table 3.

The following procedure was followed to produce the Georg Fischer test bars:

The components specified in Table 3 were mixed in a laboratory paddle mixer (Vogel & Schemmann AG, Hagen). For this purpose, the regenerate was first supplied. Then, if specified, the amorphous silicon dioxide (Elkem Mikrosilica 971) was added whilst agitating and after a mixing time of about one minute, the commercially available alkali water glass binder INOTEC® EP 3973 (Ashland-Südchemie—Kernfest GmbH) was added lastly. The mixture was then agitated for another minute.

The freshly prepared moulding material mixtures were transferred to the storage bunker of an H 2.5 hot box core shooter from Röperwerk—Giessereimaschinen GmbH, Viersen, the moulding tool being heated to 200° C.

The moulding material mixtures were introduced into the moulding tool by means of compressed air (5 bar) and remained in the moulding tool for a further 35 sec. To accelerate the curing of the mixtures, hot air (2 bar, 120° C. on entry to the tool) was passed through the tool for the last 20 seconds; The moulding tool was opened and the test bars removed.

In order to test the processing time of the moulding material mixtures, the process was repeated three hours after producing the mixture, the moulding material mixture being kept in a closed vessel during the waiting time to prevent the mixture drying out and $CO_2$ from entering.

In order to determine the flexural strengths, the test bars were inserted in a Georg Fischer strength testing apparatus, fitted with a three-point bending apparatus (DISA Industrie AG, Schaffhausen, CH) and the force resulting in rupture of the test bar was measured.

The flexural strengths were measured according to the following system:

10 seconds after removal (hot strengths)

approx. 1 hour after removal (cold strengths)

The measured strengths are summarised in Table 4.

TABLE 3

Composition of the moulding material mixtures (comparative examples)

| | Sand | Amorphous silicon dioxide[a] | Binding agent[b] |
|---|---|---|---|
| Example 1 | 100 parts by wt. H32[c] | — | 2.0 parts by wt. |
| Example 2 | 100 parts by wt. H32[c] | 0.5 parts by wt. | 2.0 parts by wt. |
| Example 3 | 100 parts by wt. mechanical regenerate 1 | 0.5 parts by weight | 2.0 parts by weight |
| Example 4 | 100 parts by wt. mechanical regenerate 2 | 0.5 parts by weight | 2.0 parts by weight |

[a]Elkem Microsilica 971
[b]INOTEC ® EP 3973 (Ashland-Südchemie-Kernfest GmbH)
[c]Quartzwerke GmbH, Frechen The weight of the test bars were determined as a further test criterion. This is also given in Table 4.

TABLE 4

| Strengths (N/cm$^2$) and core weights (g) (Comparative example) | | | | | | |
|---|---|---|---|---|---|---|
| | Hot strength (fresh mixture) | Cold strength (fresh mixture) | Core weight (fresh mixture) | Hot strength (3 h old mixture) | Cold strength (3 h old mixture) | Core weight (3 h old mixture) |
| Example 1 | 60 | 350 | 127.0 | 50 | 300 | 126.2 |
| Example 2 | 155 | 440 | 127.6 | 140 | 420 | 126.9 |
| Example 3 | 125 | 420 | 120.3 | 40 | 200 | 117.2 |
| Example 4 | 120 | 410 | 117.9 | (n) | (n) | (n) |

(n): no longer shootable

In the mechanically regenerated foundry sand used in Example 3, which was produced from foundry sand which had been hardened with water glass containing no particulate amorphous silicon dioxide (mechanical regenerate 1), a 3 h old mixture is still shootable. However, test bars which exhibit a poorer strength compared to Example 1 and 2 are obtained.

If the mechanically regenerated foundry sand contains a binding agent which contains amorphous silicon oxide (Example 4), the 3 h old mixture is cured and can no longer be shot. This shows that used foundry sands containing water glass as binding agent mixed with a particulate metal oxide are not suitable for mechanical regeneration.

3.2 Thermally Regenerated Foundry Sand

For testing the thermally regenerated foundry sands, the procedure was similar to that for the mechanically regenerated foundry sands.

The composition of the moulding material mixtures is given in Table 5, the strengths and core weights are summarised in Table 6.

TABLE 5

| Composition of the moulding material mixtures (according to the invention) | | | |
|---|---|---|---|
| | Sand | Amorphous silicon dioxide[a] | Binding agent[b] |
| Example 5 | 100 parts by wt. thermal regenerate 1 | 0.5 parts by wt. | 2.0 parts by wt. |

TABLE 5-continued

| Composition of the moulding material mixtures (according to the invention) | | | |
|---|---|---|---|
| | Sand | Amorphous silicon dioxide[a] | Binding agent[b] |
| Example 6 | 100 parts by wt. thermal regenerate 2 | 0.5 parts by wt. | 2.0 parts by wt. |
| Example 7 | 100 parts by wt. thermal regenerate 3 | 0.5 parts by wt. | 2.0 parts by wt. |
| Example 8 | 100 parts by wt. thermal regenerate 4 | 0.5 parts by weight | 2.0 parts by weight |
| Example 9 | 100 parts by wt. thermal regenerate 5 | 0.5 parts by weight | 2.0 parts by weight |
| Example 10 | 100 parts by wt. thermal regenerate 6 | 0.5 parts by weight | 2.0 parts by weight |
| Example 11 | 100 parts by wt. thermal regenerate 7 | 0.5 parts by weight | 2.0 parts by weight |
| Example 12 | 100 parts by wt. thermal regenerate 8 | 0.5 parts by weight | 2.0 parts by weight |

[a]Elkem Microsilica 971

[b]INOTEC ® EP 3973 (Ashland-Südchemie-Kernfest GmbH)

TABLE 6

| Strengths (N/cm$^2$) and core weights (g) | | | | | | |
|---|---|---|---|---|---|---|
| | Hot strength (fresh mixture) | Cold strength (fresh mixture) | Core weight (fresh mixture) | Hot strength (3 h old mixture) | Cold strength (3 h old mixture) | Core weight (3 h old mixture) |
| Example 5 | 145 | 450 | 124.4 | 135 | 410 | 123.6 |
| Example 6 | 135 | 425 | 123.3 | 125 | 385 | 121.9 |
| Example 7 | 140 | 435 | 123.4 | 125 | 390 | 122.2 |
| Example 8 | 130 | 415 | 123.1 | 130 | 400 | 122.4 |
| Example 9 | 150 | 445 | 123.1 | 135 | 405 | 122.7 |
| Example 10 | 140 | 420 | 122.9 | 130 | 395 | 122.3 |
| Example 11 | 140 | 430 | 123.1 | 125 | 405 | 122.6 |
| Example 12 | 135 | 425 | 123.2 | 130 | 390 | 122.5 |

Thermal regenerates originating from moulding material mixture 1 were used in Examples 5 to 8. This moulding material mixture used a water glass as binding agent containing no amorphous silicon dioxide. The moulding can still be shot very well after 3 hours. The test bars show very good strength.

The same result is achieved with thermal regenerates 5 to 8, as Examples 9 to 12 show. The regenerates used in these example originate from moulding material mixture 2 which contains water glass as binding agent mixed with amorphous silicon dioxide. Even after a standing time of 3 hours, the moulding material mixture can be shot very well. The test bars obtained show very good strength.

Result:

Comparison of Tables 1 and 2:

It can be seen that the acid consumption of the moulding materials is reduced considerably more substantially by the supply of heat than by mechanical regeneration. The determination of the acid consumption is at the same time a simple method of tracking the progress of the thermal regeneration.

Comparison of Tables 4 and 6:

It can be seen that the processability of the moulding material mixtures when using thermally regenerated foundry sands is significantly longer than when using mechanically regenerated foundry sands and this is regardless of whether the thermal treatment was preceded by mechanical regeneration or not.

It can also be seen that the weight of the test bars produced using the thermally regenerated foundry sands is higher than that of those test bars which were produced using mechanically regenerated foundry sands, i.e. the flowability of the moulding material mixtures has increased due to the thermal regeneration.

The invention claimed is:

1. A method for regenerating used foundry sand with binding agent based on dissolved sodium silicate or potassium silicate or both adhered thereto, said method comprising:

i) obtaining used foundry sand in the form of a used casting mould previously cured at least with dissolved sodium silicates or potassium silicates or both as a binding agent in the presence of heat and at least a particulate metal oxide, wherein the particulate metal oxide comprises at least amorphous silicon dioxide;

ii) subjecting the used foundry sand obtained in step (i) with adhered binding agent based on dissolved sodium silicate or potassium silicates or both to a thermal treatment, wherein the used foundry sand is heated to a temperature of higher than 300° C., to obtain regenerated foundry sand; and iii) preparing a moulding material mixture comprising at least a portion of the regenerated foundry sand obtained in step (ii) and dissolved sodium silicates or potassium silicates or both as a binding agent and curing the moulding material mixture in a moulding tool wherein the curing exclusively consists of applying a heat treatment to the moulding material mixture by heating the moulding tool to 100 to 300° C. and/or by blowing heated air at a temperature of 100 to 180° C. into the moulding tool to obtain a cured casting mould comprising regenerated foundry sand, wherein the method further comprises adding as part of step (iii) at least one particulate amorphous silicon dioxide.

2. The method according to claim 1, wherein the thermal treatment is carried out until the acid consumption of the foundry sand, measured by the consumption of 0.1 n HCl in a 50 g quantity of foundry sand, has decreased by at least 10%.

3. The method according to claim 1, wherein the used foundry sand is present in the form of a casting mold.

4. The method according to claim 3, wherein the used casting mold comprises a casting.

5. The method according to claim 4, wherein the casting mold is separated from the casting before the thermal treatment.

6. The method according to claim 3, wherein the casting mold is broken at least into coarse pieces before the thermal treatment.

7. The method according to claim 1, wherein a mechanical treatment of the foundry sand for grain separation is carried out before or after the thermal treatment.

8. The method according to claim 3, wherein the casting mold is transferred to a furnace for the thermal treatment.

9. The method according to claim 1, wherein the used foundry sand is agitated during the thermal treatment.

10. The method according to claim 1, wherein the thermal treatment is carried out under admission of air.

11. The method according to claim 1, wherein the regeneration is carried out dry.

12. The method according to claim 1, wherein the dissolved sodium silicates or potassium silicates or both has an $SiO_2/M_2O$ modulus in the range of 1.6 to 4.0 wherein M denotes sodium ions and/or potassium ions.

13. The method according to claim 12, wherein the dissolved sodium silicates or potassium silicates or both has a solid content of $SiO_2$ and $M_2O$ in the range of 30 to 60 wt. %.

14. The method according to claim 1, wherein amorphous silicon dioxide is selected from the group of precipitated silicic acid and pyrogenic silicic acid.

15. The method according to claim 1, wherein an organic additive is added to the molding material mixture.

16. The method according to claim 15, wherein the organic additive is a carbohydrate.

17. The method according to claim 1, wherein a phosphorus-containing additive is added to the molding material mixture.

18. The method according to claim 1, wherein the dissolved sodium silicates or potassium silicates or both has an $SiO_2/M_2O$ modulus range of 2.0 to 3.5 and M denotes sodium ions and/or potassium ions.

19. The method of claim 1, wherein the particulate metal oxide is synthetically produced amorphous silicon dioxide.

20. The method of claim 1, wherein the particulate amorphous silicon dioxide and at least the regenerated foundry sand are mixed and thereafter the water glass is added.

* * * * *